US008883242B1

(12) United States Patent
Fischell et al.

(10) Patent No.: US 8,883,242 B1
(45) Date of Patent: Nov. 11, 2014

(54) BOWL FOR KEEPING BREAKFAST CEREAL CRISPY

(71) Applicant: Crispy Cereal, LLC, Dayton, MD (US)

(72) Inventors: Robert E. Fischell, Dayton, MD (US); Susan R. Fischell, Dayton, MD (US); Scott J. S. Fischell, Hardy, VA (US)

(73) Assignee: Crispy Cereal, LLC, Dayton, MD (US)

( * ) Notice: Subject to any disclaimer, the term of this patent is extended or adjusted under 35 U.S.C. 154(b) by 0 days.

(21) Appl. No.: 13/900,762

(22) Filed: May 23, 2013

(51) Int. Cl.
*A23L 1/00* (2006.01)
*A47G 19/02* (2006.01)

(52) U.S. Cl.
CPC ..... *A47G 19/02* (2013.01)
USPC ..... 426/618; 220/575

(58) Field of Classification Search
CPC ..... A47G 19/02
USPC ..... 220/575; 426/618
See application file for complete search history.

(56) References Cited

U.S. PATENT DOCUMENTS

| | | | | | |
|---|---|---|---|---|---|
| 89,791 | A | * | 5/1869 | Pittman | 172/49.5 |
| 99,827 | A | * | 2/1870 | Scaman | 292/175 |
| 185,067 | A | * | 12/1876 | Clark, Jr. | 68/101 |
| 759,696 | A | * | 5/1904 | Gordon | D7/555 |
| D38,779 | S | * | 9/1907 | Wilhelm et al. | D7/341 |
| 876,808 | A | * | 1/1908 | Kinert | 220/575 |
| 1,100,298 | A | * | 6/1914 | Haas | 220/575 |
| 1,379,519 | A | * | 5/1921 | Bjornsen | 220/575 |
| 1,520,402 | A | * | 12/1924 | Clemans | 220/23.8 |
| 1,837,535 | A | * | 12/1931 | Duffey et al. | 452/106 |
| 2,170,311 | A | * | 8/1939 | Smith | 220/575 |
| 2,207,417 | A | * | 7/1940 | Smith | 220/575 |
| D132,100 | S | * | 4/1942 | Ipsen | D7/555 |
| D150,666 | S | * | 8/1948 | Zachary | D7/555 |
| 2,543,452 | A | * | 2/1951 | Flinchbaugh | 222/465.1 |
| D168,283 | S | * | 12/1952 | Adams | D7/555 |
| D175,499 | S | * | 9/1955 | Else | D7/555 |
| D176,824 | S | * | 1/1956 | Sacia et al. | D7/555 |
| 2,843,287 | A | * | 7/1958 | Finley | 220/575 |
| 4,069,940 | A | * | 1/1978 | Naimoli | 220/575 |
| D283,096 | S | * | 3/1986 | Uhrik | D7/555 |
| D298,898 | S | * | 12/1988 | Roshau | D7/566 |
| 4,986,433 | A | * | 1/1991 | Davis | 220/23.8 |
| 5,172,826 | A | | 12/1992 | Celaya | |
| 5,209,348 | A | | 5/1993 | Schafer, III | |
| 5,328,051 | A | * | 7/1994 | Potter et al. | 220/575 |
| 5,335,787 | A | * | 8/1994 | Finchum et al. | 206/564 |
| 5,341,953 | A | * | 8/1994 | Forester | 220/575 |
| 5,542,565 | A | * | 8/1996 | Hidalgo-Lopez | 220/574.1 |
| 5,638,981 | A | * | 6/1997 | Crane et al. | 220/574.1 |
| 5,676,275 | A | * | 10/1997 | Khattar | 220/575 |

(Continued)

FOREIGN PATENT DOCUMENTS

| | | | | |
|---|---|---|---|---|
| GB | 2 265 816 | * | 10/1993 | A47G 19/02 |

*Primary Examiner* — Rena L Dye
*Assistant Examiner* — Chaim Smith
(74) *Attorney, Agent, or Firm* — Rosenberg, Klein & Lee

(57) ABSTRACT

Disclosed is a bowl that has a cereal section and a milk and fruit section that are separated by a continuous dividing wall. The milk and fruit section has a downward slope from the dividing wall that causes the milk to enter a curved bottom section from which the eater can take the last of the cereal and milk onto his/her spoon. Also disclosed is a cover for the bowl that makes a liquid tight seal on the milk and fruit section and also covers the cereal section.

15 Claims, 4 Drawing Sheets

(56) References Cited

U.S. PATENT DOCUMENTS

| | | | | | |
|---|---|---|---|---|---|
| D386,358 | S | * | 11/1997 | Pfeilsticker | D7/555 |
| 5,853,105 | A | * | 12/1998 | Roman et al. | 220/575 |
| 5,927,538 | A | * | 7/1999 | Collins | 220/574.1 |
| D417,366 | S | * | 12/1999 | Obra | D7/549 |
| D426,751 | S | * | 6/2000 | Obra | D7/555 |
| D434,276 | S | * | 11/2000 | Obra | D7/555 |
| D439,471 | S | * | 3/2001 | Gee | D7/505 |
| D467,125 | S | * | 12/2002 | Orr et al. | D7/541 |
| 6,550,630 | B1 | * | 4/2003 | Krupa | 220/575 |
| D480,921 | S | * | 10/2003 | Roehrig | D7/543 |
| D587,517 | S | * | 3/2009 | Cheng | D7/354 |
| D587,971 | S | * | 3/2009 | Peabody et al. | D7/555 |
| D596,894 | S | * | 7/2009 | Cheng | D7/357 |
| D623,020 | S | * | 9/2010 | De Bretton Gordon | D7/555 |
| D623,021 | S | * | 9/2010 | De Bretton Gordon | D7/555 |
| D623,479 | S | * | 9/2010 | De Bretton Gordon | D7/555 |
| 8,337,073 | B2 | | 12/2012 | Roberts | |
| 2006/0207993 | A1 | * | 9/2006 | Copeland | 220/574 |
| 2008/0290097 | A1 | | 11/2008 | Fischell et al. | |
| 2010/0200597 | A1 | * | 8/2010 | Light | 220/575 |

* cited by examiner

BOWL FOR KEEPING BREAKFAST CEREAL CRISPY

FIELD OF USE

This invention is in the field of methods and devices for keeping breakfast dry cereal crispy while eating that cereal with milk and fruit or just with milk.

BACKGROUND OF THE INVENTION

When having a morning meal that includes dry breakfast cereal, a person usually adds fruit and milk to the cereal bowl. This addition of milk results in the cereal becoming soggy and not as tasty as when the cereal is dry and crispy. Although the eater typically tries to keep some cereal above the level of the milk and fruit, there is always some cereal, at least toward the bottom of the bowl, which cereal becomes soggy as it is soaked in the milk. It would be desirable to have a special bowl that would allow all the cereal in the bowl to remain dry and crispy while it is being eaten with milk or with milk and fruit.

SUMMARY OF THE INVENTION

The present invention is a cereal bowl consisting of two separate parts: a first section that contains the dry cereal with no milk that is separated by a continuous, centrally located dividing wall from a second section that contains at least the milk and usually also contains some fruit such as blueberries, raspberries, cut-up pieces of banana, cut-up pieces of apple, etc. By first taking a spoonful of cereal and then picking up some milk and fruit in that same spoon, each and every separate spoonful of the cereal that is eaten by the eater will remain crispy up to and including the very last spoonful of cereal, milk and fruit that is eaten.

The design of the present invention is distinctly different from the design of M. L. Roberts as taught in U.S. Pat. No. 8,337,073. The Roberts patent teaches (1) a partial dividing wall instead of a continuous dividing wall; (2) a cereal section that is much higher than the milk section as opposed to a cereal section that is slightly lower than the milk section; (3) the cereal is eaten by dumping it into the milk section as opposed to placing the dry cereal in a spoon and then placing that spoon with cereal into the milk, and (4) a very high outer wall that precludes using a generally horizontally placed spoon to pick up the last of the milk and cereal as opposed to a comparatively low height for the outer wall for the present invention that allows a spoon to be in an essentially horizontal position when taking up the last of the cereal and milk from a milk and fruit section that is actually not quite as deep as the cereal section.

To help assure that any tablespoon can capture every last amount of cereal and milk and fruit, both the cereal section and the milk and fruit section have rounded interior corners whose radii of curvature are somewhat greater than essentially any radius of curvature at the tip of any typical spoon that would be used for eating the dry cereal, i.e., none of the interior surfaces should be made with a sharp corner. The optimum position for the bowl will be when the rounded end of the milk and fruit section is facing the eater. In this orientation, the cereal section is situated furthest from the eater. It is then most natural for the eater to place the spoon furthest from himself or herself and pick up some cereal and then bring the spoon toward the eater and into the milk and fruit section and then still closer to put the spoon into the eater's mouth The cereal section optimally has a flat bottom that lies onto the typically flat surface of a table. This provides the maximum volume of the cereal section for containing the cereal. The present invention includes a unique inclined plane for that part of the dividing wall that faces the cereal section. By having this inclined plane with a downward slope having an angle of about 135 degrees relative to the flat bottom surface of the cereal section, all of the cereal in the cereal section will be clearly visible to the eater. This would not be the case if the dividing wall would be vertical (i.e., 90 degrees relative to the flat bottom surface) on the side facing the cereal section because there would then be some cereal at the bottom of the cereal section and against the dividing wall that could not be readily seen or as easily accessed by the eater. The dividing wall's inclined plane on the side facing the cereal section is in contradistinction to the vertical surface of the dividing wall as described in the prior art Fischell et. al. U.S. Patent Application Publication No. US2008/0290097.

Since the milk and fruit section is situated closest to the eater, the amount of milk and fruit that is situated at the bottom of a vertical dividing wall on the side of the milk and fruit section facing the eater will be clearly visible to the eater. This is a different situation compared to the cereal section of the cereal bowl where a vertical dividing wall would make the last of the cereal on that side of the dividing wall more difficult to see by the eater.

An important novel feature of the cereal bowl is that the milk and fruit section has several sloped bottom surfaces that slope downward from each and every vertical boundary wall that encloses the milk and fruit section. These boundary walls include the centrally located dividing wall as well as all the outer walls of the milk and fruit section. The sloped bottom surfaces of the milk and fruit section all terminate at their lowest point at a horizontally placed outer boundary line of a curved bottom section that is located at the lowest region of the milk and fruit section of the cereal bowl. The separate curved bottom section is designed to be the place where the last of the milk and fruit can be readily picked up by a conventional tablespoon. It is important that this curved bottom section has an area that is comparatively small compared to the area of the bottom surfaces of the entire milk and fruit section so that the milk has some substantial height in that curved bottom section when the last spoonful of cereal and milk is to be eaten. The sloped surfaces of the milk and fruit section cause the last of the remaining milk to move into the curved bottom section where the last spoonful of the milk and fruit is to be taken up by the eater. To accomplish that goal, the curved bottom section should have a central cylindrical section with a length that is between 60% and 80% of the width of the milk and fruit section at that location. The cylindrical section should have a radius of curvature in its transverse direction that is slightly larger than the radius of curvature of the transverse cross section at the center of the spoon of a typical tablespoon that is used to eat dry cereal. The curved bottom section should have at each of its end a curved portion that has a radius of curvature that is somewhat larger than the curvature at the end of a typical tablespoon. The shape of this curved portion at each end of curved bottom section is a sector of a torroid. This unique shape is not noted in any prior art cereal bowl patent.

The total width of the outer boundary line at the top of the curved bottom section should be approximately 10% to 30% smaller than the maximum width of the milk and fruit section at that location. The dimension of the curved bottom section in a direction perpendicular to its width should be less than 50% of the length of the milk and fruit section in that direction. Ideally, the area of the entire milk and fruit section (including the curved bottom section) should be approximately two and one-half to three times the area of the outer boundary line of the curved bottom section. These ratios provide the a good high height of the milk within the curved bottom section for the last to be eaten of the cereal and milk.

It is also important that this curved bottom section is at a position in the bowl that is between the dividing wall and the opposite end of the milk and fruit section to make it optimally situated for the eater to pick up the last of the cereal, milk and fruit. That would be the location that is optimally situated for the eater to collect the last spoonful(s) of cereal and milk and fruit. The direction of the long axis of the curved bottom section should be parallel to the dividing wall and its ends should extend nearly to touch the interior wall of the milk and fruit section. With this configuration, a left handed eater could approach with his spoon from the left side of the curved bottom section and a right handed eater could approach the curved bottom section from the right side. This design is in contradistinction to the design taught by C. Celaya in U.S. Pat. No. 5,172,826 which has a curved bottom section that is too large a diameter on one end and too small at the other end to readily pick up the last spoonful of cereal with milk and fruit.

In US Patent Application Publication US2008/0290097, Fischell, et. al. teach a cereal bowl 10 that has an inclined section 19 within the milk and fruit section 12 that connects to a curved bottom section 16 that is situated against the center divide 18 of the cereal bowl 10. FIGS. 1 and 2 of the Fischell et. al. application show that (1) the curved bottom section 16 has the same width as the interior width of the milk and fruit section 14, (2) the curved bottom section 16 has straight ends that are less efficient for picking up the last of the milk and fruit with a curved spoon, and (3) the curved bottom section 16 has a comparatively large area compared to the total area of the entire milk and fruit section; and (4) the dividing wall 18 on the cereal side of the cereal section is vertical rather than being inclined. Because of each and every one of these differences in design, the design taught in the prior Fischell et. al. patent application is not an optimum design for a cereal bowl. This prior art design is in contradistinction to the design of the present invention which teaches several sloped surfaces within the milk and fruit section that all slope downward toward the outer boundary line of the curved bottom section, a curved bottom section that is rounded at its ends instead of straight at its ends and has an area that is much less than 50% of the area of the milk and fruit section as compared to the much larger area of the curved bottom section 16 of the design taught in the Fischell et. al. application. The present invention teaches two sloped surfaces, one on either side of the outer boundary line of the curved bottom section as opposed to the Fischell et. al. publication that teaches a sloped surface on only one side of the curved bottom section. Therefore, the bowl design as disclosed herein provides a decreased maximum height of the bottom surface of the milk and fruit section of the bowl. By decreasing the maximum height of the sloped sections, a somewhat greater volume for the milk and fruit section of the present invention is obtained as compared to one, longer sloped surface as taught in the Fischell et. al. patent publication which creates a somewhat smaller volume within the milk and fruit section. Thus the design of the present invention is clearly different from and superior to the design previously described in the Fischell et. al. application.

Another novel feature of the present invention is a unique cover for a bowl that has two separate sections. The portion of the cover that covers the milk and fruit section of the cereal bowl has a liquid tight seal against the interior surface of that section of the cereal bowl so that a liquid (such as milk) would not leak out of that section even if the bowl was significantly tilted or even if it were turned upside down. This cover with a liquid tight seal prevents a child from accidently spilling the milk when, for example, the cereal bowl with cereal and milk was to be removed from a refrigerator where it would have been placed the prior evening by the child's mother in preparation for the child's breakfast. The seal of the cover over the cereal section of the cereal bowl would only have to be in contact with the outer edges of the cereal section because dry cereal would not fall out of the cereal section even if it did not have a pressure tight seal. The cover would ideally have an outwardly extending flap located as far away from the milk and fruit section as possible, which flap could be used for easy removal of the cover when the cereal bowl was to be opened.

The design of the cover of the present invention is distinctly different from that described by V. Schafer III in U.S. Pat. No. 5,209,348. The Schafer patent teaches a round bowl with two different covers, one for the cereal section and a second cover for the milk section. The single cover design as disclosed herein is obviously easier to apply and it is able to be removed with a single tab at the end of the cereal section of the bowl as opposed to the two cover design of the Schafer invention.

It is also conceived that the cereal bowl as described herein could be made in a variety of colors so that each person who uses such a bowl could have his or her favorite color. For a busy mother with several children, bowls of a different color could be used for each child that would have that child's favorite cereal in that particular bowl.

Another reason for having the novel design of a cereal bowl with a cover that includes a liquid tight seal for the milk and fruit section is that there are many workers who go to work early and would like to have a breakfast of cereal with milk and fruit that they take from home to be eaten at their place of employment. Having an easily removable single cover as taught herein makes it possible for such a worker to prepare his or her favorite cereal with milk and fruit at home, then place the cover with a liquid tight seal onto the top of the cereal bowl and then take the covered cereal bowl to work. One aspect of the present invention is a cereal bowl with such a cover that provides this useful and novel capability.

For the present invention it should be understood that the use of the word "milk" can also mean any liquid that might be eaten with dry cereal such as cream, water, soy milk, lactose free milk, coconut milk, almond milk, rice milk, hemp milk, sunflower seed milk oat milk, chocolate milk, non-fat milk, 1% butterfat milk, 2% butterfat milk, etc.

Thus one object of the present invention is to have a two section bowl that separates by a continuous dividing wall the dry cereal from the milk and fruit so that all the dry cereal can be eaten while it is still crispy.

Another object of this invention is to have an inclined surface at the dividing wall on the cereal section side of the cereal bowl to provide assurance that all the cereal is clearly visible for the eater.

Still another object of this invention is to have multiple downward sloping surfaces at the bottom of the milk and fruit section of the cereal bowl each downward surface terminating at the outer boundary line of the curved bottom section within the milk and fruit section of the cereal bowl thereby assuring that the last of the milk to be eaten will be situated in that curved bottom section.

Still another object of this invention is that the curved bottom section is of limited area and limited volume as compared to the entire area and volume of the milk and fruit section of the cereal bowl.

Still another object of this invention is that the curved bottom section terminates at each end with a curved surface to optimize picking up of the last to be eaten of the milk and fruit with the curved end of a spoon.

Still another object of this invention is that the curved bottom section terminates at each end with a curved surface that is situated close to an interior wall of the milk and fruit section, the curved bottom section having its long axis parallel to the dividing wall to optimize picking up of the last of the milk and fruit with the curved end of a spoon for either a left handed eater or a right handed eater.

Still another object of this invention is to have all the curved interior surfaces of the cereal bowl's outer walls having a somewhat greater radius of curvature compared to the curvature at the tip of a conventional tablespoon so that even the last of the cereal and the last of the milk and fruit can be readily picked up on such a spoon.

Still another object of this invention is to have a special cover for the cereal bowl that provides a liquid tight seal for the milk and fruit section and that same cover also covering the cereal section of the cereal bowl with a seal that is more easily removable by not being a liquid tight seal.

These and other objects and advantages of this invention will become obvious to a person of ordinary skill in this art upon reading the detailed description of this invention including the associated drawings as presented herein.

DETAILED DESCRIPTION OF THE INVENTION

Figure 1:
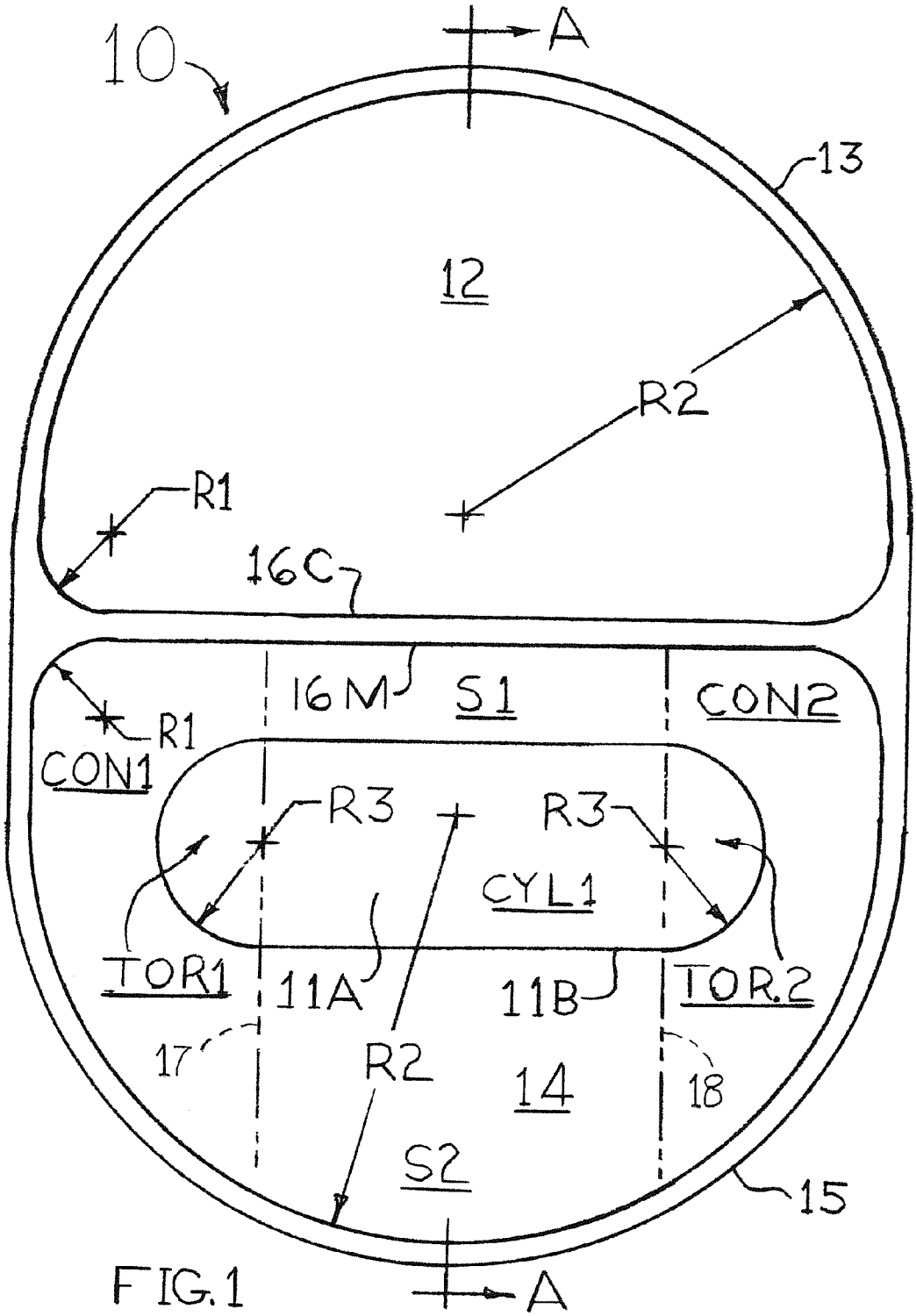
FIG. 1 is a top view of the cereal bowl.

FIG. 1 is a top view of a cereal bowl 10 having a dry cereal section 12 that is separated by the dividing wall surface 16C on the cereal section 12 side of the cereal bowl 10, and a dividing wall surface 16M facing the milk and fruit section 14. The dividing wall surfaces 16C and 16M should be continuous with no openings that would allow the dry cereal to be inadvertently swept into the milk and fruit section 14. In getting ready for a person's breakfast, he or she would place dry cereal in the dry cereal section 12 and would also place at least milk (or cream) in the milk and fruit section 14 and would typically also place fruit into that section 14. The radius R1 of the dry cereal section 12 and the milk and fruit section 14 would each be larger than the radius of curvature at the end of any typical tablespoon. For example, the radius R1 would typically be between 0.3 inch and 1.0 inch. It should be understood that these radii R1 in each of the cereal section 12 or the milk and fruit section 14 could be the same or they could be somewhat different. The radius R2 of both the cereal section 12 and the milk and fruit section 14 should be approximately 3 inches with a possible range between 2 and 4 inches.

Figure 2:
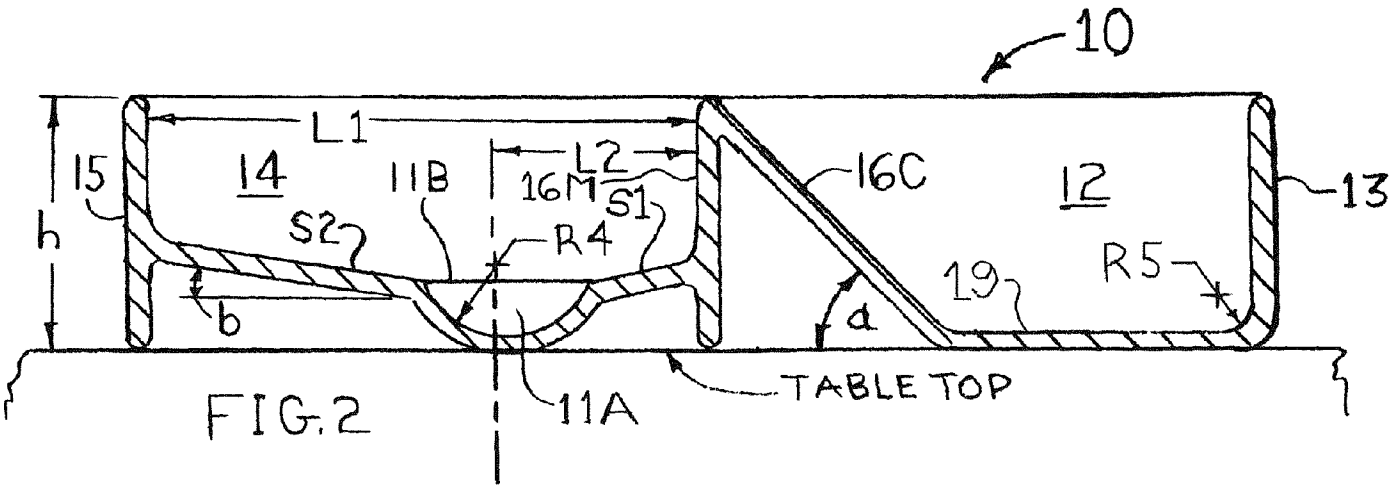
FIG. 2 is a cereal bowl cross section at section A-A of FIG. 1.
Figure 3:
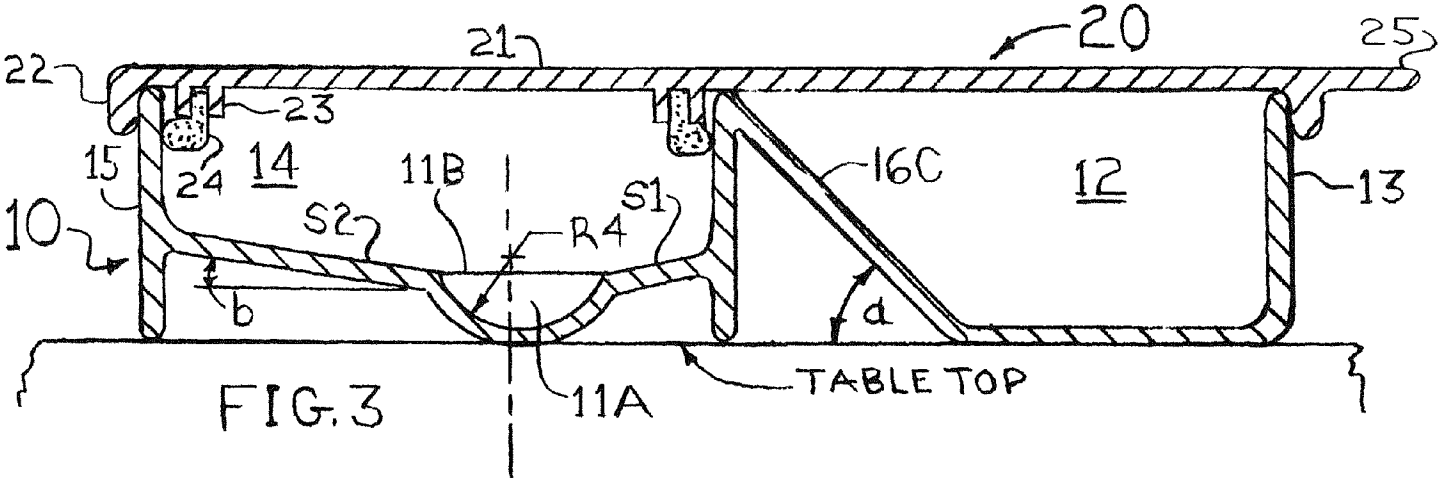
FIG. 3 is a cross section of the cereal bowl showing the details of the special cover that provides a liquid tight seal for the milk and fruit section of the cereal bowl and a cover for the cereal section of the cereal bowl.

As seen in FIGS. 1, 2 and 3, the dry cereal section 12 has an outside vertical wall 13 and the milk and fruit section 14 has an outside vertical wall 15. A vertical dividing wall 16M on the milk and fruit section 14 side of the cereal bowl 10 and an inclined dividing wall surface 16C on the cereal side of the bowl 10 separate the dry cereal section 12 from the milk and fruit section 14. A typical height, h, for the cereal bowl 10 would be between 1.25 and 2.5 inches. Heights greater than 2.5 inches would make it somewhat more difficult to eat the cereal because it would be difficult to have the spoon in a horizontal orientation when eating the last of the cereal with milk and fruit. It should be understood that the vertical walls 13 and 15 could be somewhat sloped in an outward direction without interfering with the ability of the eater to pick up his/her cereal and/or milk and fruit. Also, it should be understood that each of the walls 13 and 15 could have a somewhat increased wall thickness at their top (not shown) to make it appear that the walls have an increased wall thickness and for snapping on a cover 20 for the cereal bowl 10.

As best seen in FIG. 2, the milk and fruit section 14 has different slopes of its bottom surface as compared to the cereal section 12 that has a flat bottom. The flat bottom 19 of the cereal section will sit flat onto a table top and, by having a flat surface, it provides a maximum volume of cereal for a specific height, "h" of the wall 13.

FIG. 2 shows that the total length L1 of the milk and fruit section 14 that is perpendicular to the dividing wall 16M will be about 2.5 to 3.5 times greater than the length L2 which is the distance away from the dividing wall 16M of the centerline of the curved bottom section 11A.

As indicated in FIG. 1, the milk and fruit section 14 has four different sloped portions that each slope toward, and terminate at, the horizontal outer boundary line 11B of the curved bottom section 11A. Two of these slopes, S1 and S2 are best seen in FIGS. 2 and 3. From the dividing wall surface 16M, a flat, downward sloping surface S1 terminates at its lowest point at the portion of the outer boundary line 11B that is at the top of the cylindrical portion CYL1 of the curved bottom section 11A of the milk and fruit section 14. As best seen in FIGS. 2 and 3, the cylindrical portion CYL1 of the curved bottom section 11A of the milk and fruit section 14 has a radius of curvature R4 that should be slightly larger than the curvature at the transverse cross section at the center of the spoon portion of a typical tablespoon. The radius of curvature for the cylindrical portion CYL1 of the curved bottom section 11A should optimally be between 1.0 and 1.5 inches.

The second flat, downward sloping surface of the milk and fruit section 14 is the surface S2 (as seen in FIGS. 1 and 2) which slopes downward from the wall 15 and terminates at the outer boundary line 11B that is at the top of the cylindrical portion CYL1 of the curved bottom section 11A. As seen in FIG. 1, the outer boundary line 11B has a semi-circular edge at each of its ends with a radius of curvature R3 that is slightly larger than the radius of curvature at the end of the spoon of a typical tablespoon or teaspoon as used to eat the cereal.

Figure 4:
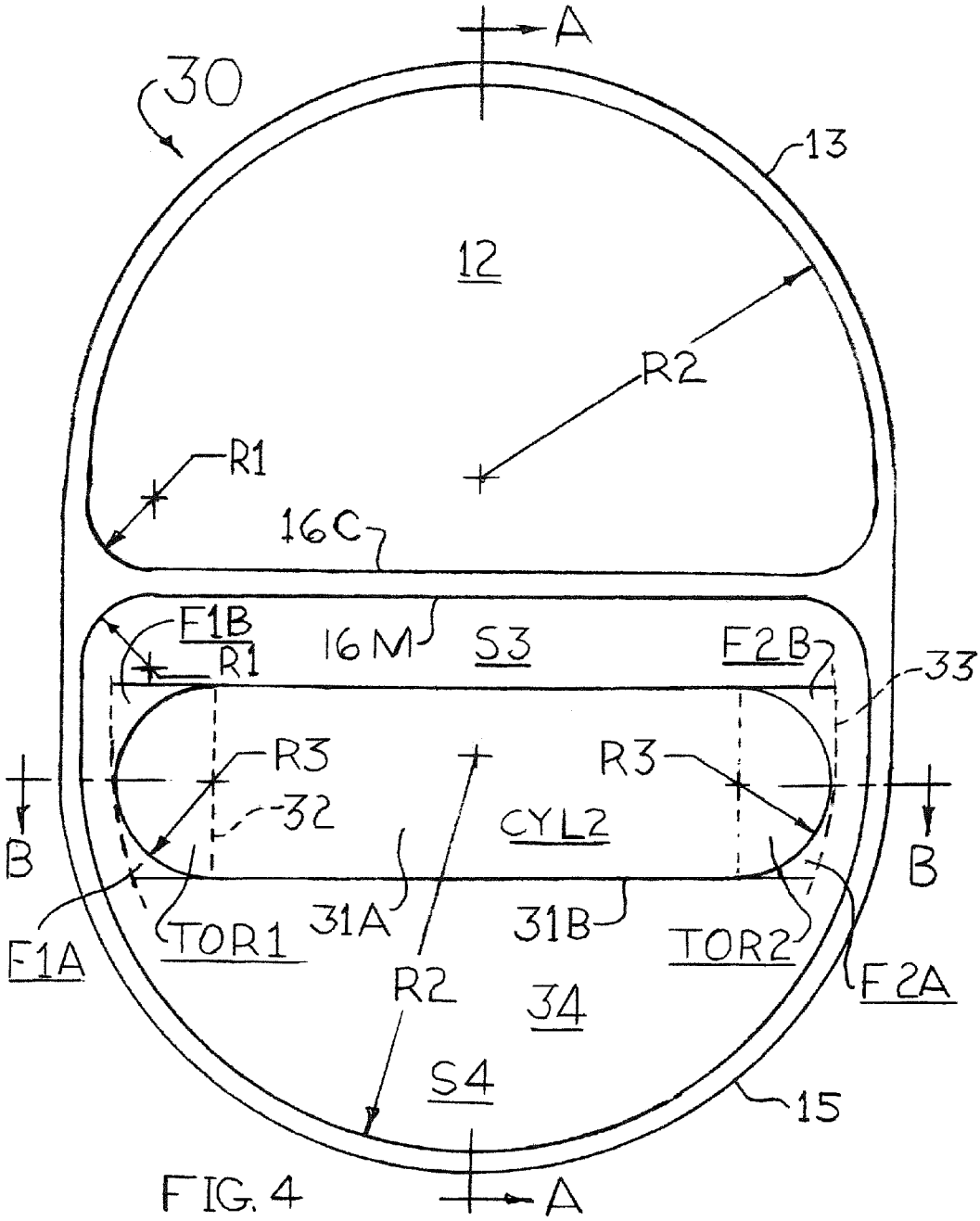
FIG. 4 is a top view of an alternative embodiment of the present invention that has an extended length for the curved bottom section of the milk and fruit section.
Figure 5:
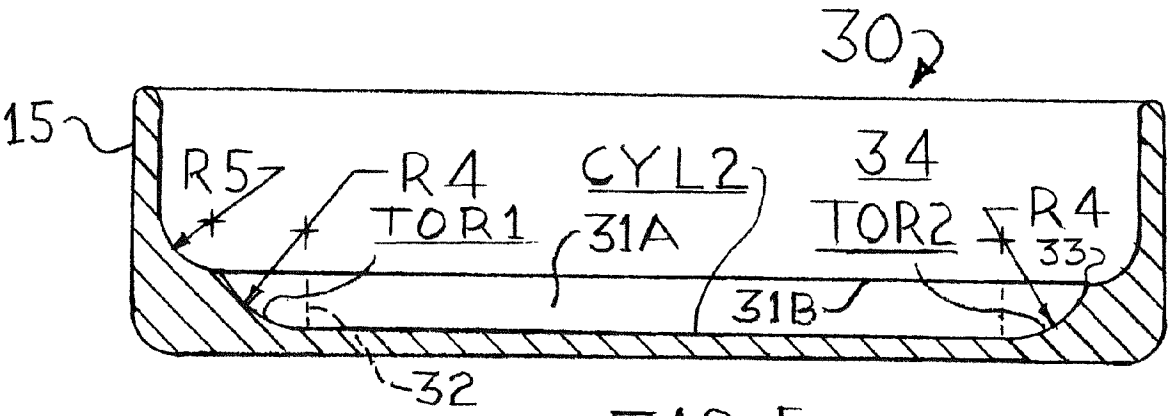
FIG. 5 is a cross section at B-B of the cereal bowl of FIG. 4 showing how the ends of the curved bottom section join to the exterior walls of the milk and fruit section.

As seen in FIG. 1, the third and fourth downward sloping surfaces of the milk and fruit section 14 are the conical surfaces CON1 and CON2 that slope downward from the dividing wall surface 16M and the outer wall 15 toward the outer boundary line 11B at its curved, semi-circular ends. At each end of the curved bottom section 11A are the sections TOR1 or TOR2 each of which has a curvature R4 at its bottom (as seen in FIGS. 2, 3 and 5) and a smaller, semi-circular curvature R3 (as seen in FIGS. 1 and 4) at each end of the outer boundary line 11B. The surfaces TOR1 and TOR2 are in fact a small section of a torroidal surface.

The horizontal outer boundary line 11B is the termination at the bottom of the downward sloping surfaces S1, S2, CON1 and CON2. This unique design causes all the last of the milk to go into the curved bottom section 11A and allows the eater to have the greatest height for the milk within that curved bottom section 11A. This design allows the eater to easily pick up the last of the milk with still crispy cereal. It should be noted that the imaginary lines 17 and 18 in FIG. 1. indicate the position where the conical surfaces CON1 and CON2 join the planar slopes S1 and S2 in a continuous manner. This unique design provides a smooth transition between these two different geometric surfaces, a planar surface and a conical surface.

An important novel feature of the curved bottom section 11A is that the radius of curvature R4 at its bottom is slightly larger than the radius of curvature at the center of the spoon of a typical tablespoon and the radius of curvature R3 at the end curved sections of the outer boundary line 11B are somewhat greater than the radius of curvature at the tip of a typical tablespoon. This design assures that the typical tablespoon will be able to efficiently go into the curved bottom section 11A to pick up the last to be eaten of the cereal and milk.

It should be understood that this method for eating a dry cereal with milk and fruit and keeping that dry cereal crispy would be accomplished in an optimum manner when the milk and fruit section 14 is placed closest to the eater. It is also important that the area "A1" of the outer boundary line 11B of the curved bottom section 11A is approximately 20% to 40% of the area "A2" of the entire milk and fruit section 14 that includes the outer boundary line 11B. This minimization of the area "A1" compared to the area "A2" of the entire milk and fruit section 14 allows the height of the last of the milk and fruit to be maximized so that the last remaining volume of milk can be easily picked up onto a spoon to be eaten by the eater without wasting essentially any of the milk.

FIG. 2 shows an angle "a" between the table top and the sloped dividing wall surface 16C. The angle "a" should be approximately 30 to 60 degrees with an optimum angle being approximately 45 degrees. Thus the angle between the sloped dividing wall 16C and the flat bottom 19 of the cereal section 12 will be approximately 150 to 120 degrees with and optimum angle being 135 degrees.

FIG. 2 also shows an angle "b" between the sloped surface S2 and a horizontal plane. The angle "b" is optimally between 3 and 17 degrees with an optimum angle being approximately 10 degrees. This angle "b" is also the angle that the conical surfaces CON1 and CON2 each make with a horizontal plane.

FIG. 3 is a cross section of the cereal bowl 10 having a plastic cover 20. The cover 20 has a top portion 21 with a circumferential sealing extension 23 that extends around the entire interior surface of the milk and fruit section 14. The sealing extension 23 has a projection 24 that provides a liquid tight seal against the entire interior surface of the milk and fruit section 14. The projection 24 could be formed from a soft, rubber-like material to provide an optimum means for sealing. Thus, even if the cereal bowl 10 would be severely tilted or even turned upside down, no milk would leak out of the milk and fruit section 14. The friction of the projection 24 against the interior surface of the milk and fruit section 14 is what will tightly hold the cover 20 onto the bowl 10.

FIG. 3 also shows that the cover 20 has a downward projection 22 that extends around the entire perimeter of the cereal bowl 10. A cover 20 having this design will retain the cereal within the cereal section 12. For the cereal section 12, a liquid tight seal is not necessary. The projection 22 around the outside of the vertical wall 13 of the cereal section 12 should provide a sufficient seal to prevent cereal from coming out of the cereal section 12 of the cereal bowl 10. The projection 22 could also exert a frictional force against the exterior wall 13 of the cereal section 12 to help retain the cover 20 onto the bowl 10. An extension tab 25 could be provided on the cover 20 for easy removal of the cover 20 from the bowl 10. Such a tab 25 could be approximately 1.0 inch wide and ½ of an inch long or any similar dimensions. One or more tabs 25 could be placed around the cover 20. Placing the tab 25 at the end of the cover opposite the milk and fruit section 14 of the cereal bowl 10 is optimum for exerting the most torque on the cover 20 to work against the frictional force created by the seal 24 around the interior surface of the milk and fruit section 14 for easiest removal of the cover 20 from the cereal bowl 10.

It should be understood that the bowl 10 and/or the cover 20 could be molded from any one of the several plastics that are now used for making bowls of various designs. Typical plastics that could be used are as follows: polypropylene, polycarbonate, high impact polystyrene, polyurethane, Nylon, etc. An optimum plastic for the bowl 10 would be BPA-free polypropylene. Still further, it should be understood that the bowl could be made in various colors such as a cream color, light red color or any acceptable shade of green, yellow, orange or blue. The bowl could also have designs or a company name placed on its surfaces. Still further, a high end of the cereal bowl could be made from a ceramic material.

FIGS. 4 and 5 illustrate an alternative embodiment cereal bowl 30 that has the same cereal section 12 with somewhat different milk and fruit section 34. In FIG. 4 it can be seen that the entire length of the cylindrical section CYL2 of FIGS. 4 and 5 is significantly longer than the length of the cylindrical section CYL1 of FIG. 1. It is best seen in FIG. 5 that the semi-circular ends of the outer boundary line 31B actually make contact with the interior bottom curve having a radius of R5 of the vertical wall 15 of the milk and fruit section 34. It is also seen in FIGS. 4 and 5 that the curved section of the surface TOR1 makes contact with an imaginary line 33 that is at the bottom of the inside curved surface having a radius R5 located at the bottom of the outer wall 15 of the milk and fruit section 34. The extended length of the cylindrical section CYL2 allows an additional volume for the last to be eaten of the milk and fruit. It should also be noted that the dotted line 32 indicates the imaginary junction line where the cylindrical section CYL2 smoothly joins with the section of a torroidal surface TOR1 or TOR2.

FIG. 4 shows that the planar surfaces S3 and S4 extend to intersect the imaginary lines 33 at the bottom curve having a radius R5 located at the bottom of the wall 15 of the milk and fruit section 34. For this design, it is envisaged that the tiny flat surfaces F1A, F1B, F2A and F2B that lie between the semi-circular ends of the outer boundary line 31B and the imaginary lines 33 could be flat without accumulating any significant amount of the last to be eaten of the cereal and milk and fruit because they have a very small area.

Each one of the figures herein shows that the outer boundary line 11B or 31B is essentially a comparatively sharp line connection between two surfaces. Alternatively, it should be understood that any part or all of the upper boundary between the curved bottom section 11A or 31A and the surfaces that are contacted by the outer boundary line 11B or 31B could, in fact, be a curved surface to allow for a smoother transition between the outer boundary line 11B or 31B and the surfaces that join to it. A radius of curvature for such a curved surface at the top of either curved bottom section 11B or 31B would optimally lie between 0.05 and 0.20 inches.

Various other modifications, adaptations and alternative designs are of course possible in light of the teachings as presented herein. Therefore it should be understood that, while still remaining within the scope and meaning of the appended claims, this invention could be practiced in a manner other than that which is specifically described herein.

What is claimed is:

1. A cereal bowl comprising two main sections enclosed within an outer bowl wall, the first main section consisting of a cereal section; the second main section consisting of a milk and fruit section; each of said main sections being separated by a continuous dividing wall extending throughout a transverse length of the cereal bowl; the milk and fruit section having at least two bottom surfaces having a downward slope toward a horizontal outer boundary line which is displaced from and parallel to the continuous dividing wall, said outer boundary line being an upper boundary of a further curved bottom section defining a concavity projecting below the at least two bottom surfaces having a downward slope and having curved ends which are formed in the milk and fruit section, the outer boundary line being closer to the continuous dividing wall than the outer bowl wall and being separated from said dividing wall by one of the downward sloping bottom surfaces of said milk and fruit section where the continuous dividing wall has an inclined slope on the cereal section side of the cereal bowl.

2. The cereal bowl of claim 1 where the inclined slope of the continuous dividing wall on the cereal section side of the cereal bowl makes an angle between the flat bottom surface of the cereal section and the inclined slope that lies between 120 degrees and 150 degrees.

3. The cereal bowl of claim 1 where the outside walls of the cereal section and the milk and fruit section are essentially vertical.

4. The cereal bowl of claim 1 where the radius of curvature of the inside surfaces of the outside walls of the cereal section and the milk and fruit section is between 0.3 and 1.0 inch at those places where they join to the dividing wall.

5. The cereal bowl of claim 1 where the height of the cereal bowl is between 1.25 and 2.5 inches.

6. The cereal bowl of claim 1 where the outer boundary line of the curved bottom section has an area A1 that is approximately 30% to 40% of the entire area A2 of the milk and fruit section.

7. The cereal bowl of claim 1 where there are four sloped surfaces within the milk and fruit section of the cereal bowl, each of the four sloped surfaces terminating at their lowest point along the horizontal outer boundary line of the curved bottom section of the milk and fruit section, two of the surfaces being flat, downward sloping planes, and the other two surfaces being conical surfaces that terminate at their lowest point along a semi-circular line situated at each end of the outer boundary line of the curved bottom section of the milk and fruit section of the cereal bowl.

8. The cereal bowl of claim 1 where there are two planar flat surfaces that slope downward to terminate for most of their lowest length along the straight sections of the outer boundary line of the curved bottom section of the milk and fruit section of the cereal bowl.

9. The cereal bowl of claim 1 where the material from which the bowl is made is selected from the group consisting of polypropylene, polycarbonate, high impact polystyrene, polyurethane, Nylon, or any equivalent plastic material.

10. The cereal bowl of claim 1 where the material from which the bowl is made is BPA-free polypropylene.

11. The cereal bowl of claim 1 where the bowl is made from a ceramic material.

12. The cereal bowl of claim 1 where the cereal section has a flat bottom for placement directly onto the table surface where the cereal bowl is placed, the flat bottom allowing the volume of the cereal in the cereal section to be maximized.

13. The cereal bowl of claim 1 where the curved bottom section of the milk and fruit section has a curvature with a radius that generally matches the transverse curvature at the center of the spoon portion of a typical tablespoon, that curvature being between 1.0 and 1.5 inches.

14. A cereal bowl comprising two main sections enclosed within an outer bowl wall and a single plastic cover, the first main section consisting of a cereal section; the second main section consisting of and a milk and fruit section; each of said main sections being separated by a continuous dividing wall extending throughout a transverse length of the cereal bowl; the milk and fruit section having at least two bottom surfaces having a downward slope toward a horizontal outer boundary line which is displaced from and parallel to the continuous dividing wall, said boundary line being an upper boundary of a further curved bottom section defining a concavity having curved ends which are formed in the milk and fruit section; the single plastic cover forming a liquid tight seal placed within an interior surface of the milk and fruit section, the liquid tight seal preventing the milk from coming out of the milk and fruit section, the cover also extending over the cereal section which prevents the cereal from falling out of the cereal bowl.

15. The cereal bowl of claim 14 where the cover has a tab extending from the perimeter of the cover that allows for easy removal of the cover from the cereal bowl, the tab being placed at a position on the cover that is furthest from the milk and fruit section of the cereal bowl.

* * * * *